US010473340B2

(12) United States Patent
Tomoigawa

(10) Patent No.: US 10,473,340 B2
(45) Date of Patent: Nov. 12, 2019

(54) INDOOR UNIT FOR AIR-CONDITIONING APPARATUS

(71) Applicant: Mitsubishi Electric Corporation, Tokyo (JP)

(72) Inventor: Shinji Tomoigawa, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 403 days.

(21) Appl. No.: 14/896,680

(22) PCT Filed: Aug. 22, 2013

(86) PCT No.: PCT/JP2013/004955
§ 371 (c)(1),
(2) Date: Dec. 8, 2015

(87) PCT Pub. No.: WO2015/025342
PCT Pub. Date: Feb. 26, 2015

(65) Prior Publication Data

US 2016/0131368 A1 May 12, 2016

(51) Int. Cl.
*F24F 1/0011* (2019.01)
*F24F 1/0007* (2019.01)
*F24F 1/0033* (2019.01)

(52) U.S. Cl.
CPC ..... *F24F 1/0011* (2013.01); *F24F 1/0007* (2013.01); *F24F 1/0033* (2013.01)

(58) Field of Classification Search
CPC ..... F24F 1/0011; F24F 1/0007; F24F 1/0033; F24F 13/12; F24F 1/0041; F24F 2003/006
(Continued)

(56) References Cited

U.S. PATENT DOCUMENTS 5,076,346 A * 12/1991 Otsuka ..... F24F 3/044 165/217
2005/0163615 A1* 7/2005 Chheda ..... H01L 23/34 416/31
(Continued)

FOREIGN PATENT DOCUMENTS

JP S54-1943 U 1/1979
JP H10-009725 A 1/1998
(Continued)

OTHER PUBLICATIONS

Matsunaga, Koji, Method of Controlling Fan of Cooling Apparatus for Indoor Transformer , Jan. 19, 2006, European Patent Office, English Translation (Year: 2006).*
(Continued)

*Primary Examiner* — Frantz F Jules
*Assistant Examiner* — Steve S Tanenbaum
(74) *Attorney, Agent, or Firm* — Posz Law Group, PLC

(57) ABSTRACT

The present invention provides an indoor unit for an air-conditioning apparatus which can separately control separate air-sending devices according to an operation state of two outdoor units connected with the indoor unit, and can pass winds generated by the separate air-sending devices to separate heat exchangers without any waste. This indoor unit for an air-conditioning apparatus includes; one box-shaped casing having an air inlet and an air outlet; a partition plate part partitioning the inside of the box-shaped casing to form two wind passages; separate air-sending devices provided respectively in the wind passages to suction air through the air inlet into the wind passage and blow out the air through the air outlet; and separate heat exchangers provided respectively in the wind passages between the separate air-sending device and the air outlet, connected respectively with inde-
(Continued)

pendent outdoor units to configure separate refrigerant circuits, and air-conditioning the air suctioned.

10 Claims, 11 Drawing Sheets

(58) Field of Classification Search
USPC ..... 62/426
See application file for complete search history.

(56) References Cited

U.S. PATENT DOCUMENTS

2013/0026404 A1* 1/2013 Tan ..... H05K 7/20145 251/304
2013/0052936 A1* 2/2013 Jordan ..... F24F 13/14 454/338

FOREIGN PATENT DOCUMENTS

JP 2001-174025 A 6/2001
JP 2002-013798 A 1/2002
JP 2004-226012 A 8/2004
JP 2006019349 A * 1/2006
JP 2006-064254 A 3/2006
JP 2010-230210 A 10/2010
JP 2011-080617 A 4/2011
JP 2011-144996 A 7/2011

OTHER PUBLICATIONS

International Search Report of the International Searching Authority dated Nov. 26, 2013 for the corresponding international application No. PCT/JP2013/004955 (and English translation).
Japanese Office Action dated May 24, 2016 in the corresponding JP application No. 2015-532584. (English translation attached).

* cited by examiner

INDOOR UNIT FOR AIR-CONDITIONING APPARATUS

CROSS REFERENCE TO RELATED APPLICATION

This application is a U.S. national stage application of International Application No. PCT/JP2013/004955 filed on Aug. 22, 2013, the disclosure of which is incorporated herein by reference.

TECHNICAL FIELD

The present invention relates to an indoor unit for an air-conditioning apparatus, and more particularly relates to an indoor unit in which the inside of a box-shaped casing is partitioned into a plurality of wind passages and a plurality of air-sending devices including a motor and a fan are installed in the wind passages.

BACKGROUND ART

Conventionally, among air-conditioning apparatuses having a ceiling concealed indoor unit, there is known one in which the indoor unit has a large size and two independent heat exchangers are provided for the one indoor unit inside a box-shaped casing. These two heat exchangers are connected respectively with two outdoor units each configuring a refrigerant circuit. In many cases, an air-sending device has one motor, and one or two fans are mounted on the rotary drive shaft of the motor. In such two-fan-type air-sending devices, of which the two motors are sometimes installed inside a box-shaped casing, motors and fans of the same types are used and both air-sending devices are subjected to the same control (e.g., see Patent Literature 1).

CITATION LIST

Patent Literature

Patent Literature 1: Japanese Patent Laid-Open No. 2011-80617

SUMMARY OF INVENTION

Technical Problem

An air-conditioning apparatus, which has two outdoor units connected with one indoor unit, includes two heat exchangers connected respectively with the outdoor units. When the required capacity decreases, either of the two outdoor units may be stopped and only a half of the divided heat exchangers of the indoor unit may be used. Since both fans are operated even in this case, winds are also passed to a part of the divided heat exchangers where no refrigerant is flowing, which wastefully consumes energy of the air-sending devices.

In connection with this problem, apart from the case of one motor, even in the case where two air-sending devices are provided, these two motors are of the same model and subjected to the same rotation speed control. Thus, even when two motors are provided, these two motors are subjected to the same control. Accordingly, both motors are always in operation as long as the indoor unit is in operation. As this remains the same even if the required air-sending capacity decreases, the total accumulated operating hours of the two motors amount to a large number.

Solution to Problem

In order to solve the above problems, an indoor unit for an air-conditioning apparatus according to the present invention includes: one box-shaped casing having an air inlet and an air outlet; a partition plate part partitioning an inside of the box-shaped casing to form at least two wind passages communicating the air inlet and the air outlet with each other; separate air-sending devices provided respectively in the wind passages to suction air through the air inlet into the wind passage and blow out the air through the air outlet; and separate heat exchangers provided respectively in the wind passages between the separate air-sending device and the air outlet, connected respectively with independent outdoor units to configure separate refrigerant circuits, and air-conditioning the air suctioned through the air inlet.

Advantageous Effects of Invention

In the large-size indoor unit for an air-conditioning apparatus according to the present invention, it is possible to separately control the separate air-sending devices according to an operation state of the plurality of outdoor units connected with the one indoor unit. Thus, the present invention allows for high-efficiency operation by sending no wind to a separate heat exchanger where no refrigerant is flowing.

DESCRIPTION OF EMBODIMENTS

In the following, embodiments of the present invention will be described on the basis of the drawings.

Embodiment 1

Figure 1:
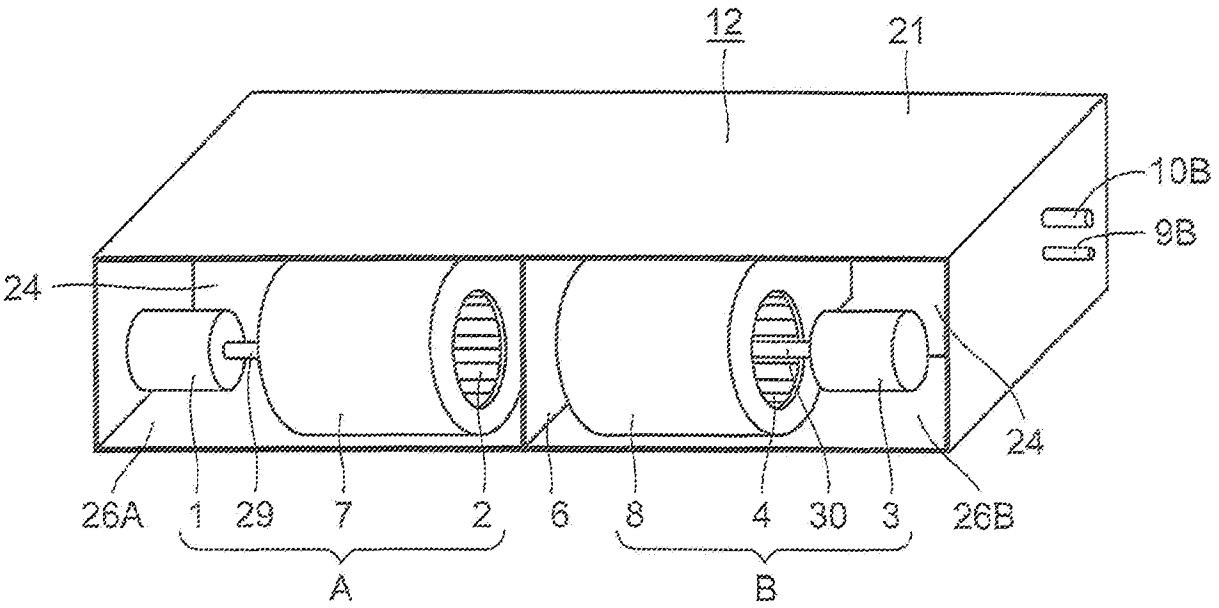
FIG. 1 is a perspective front view in outline of an indoor unit for an air-conditioning apparatus according to Embodiment 1 of the present invention.
Figure 2:
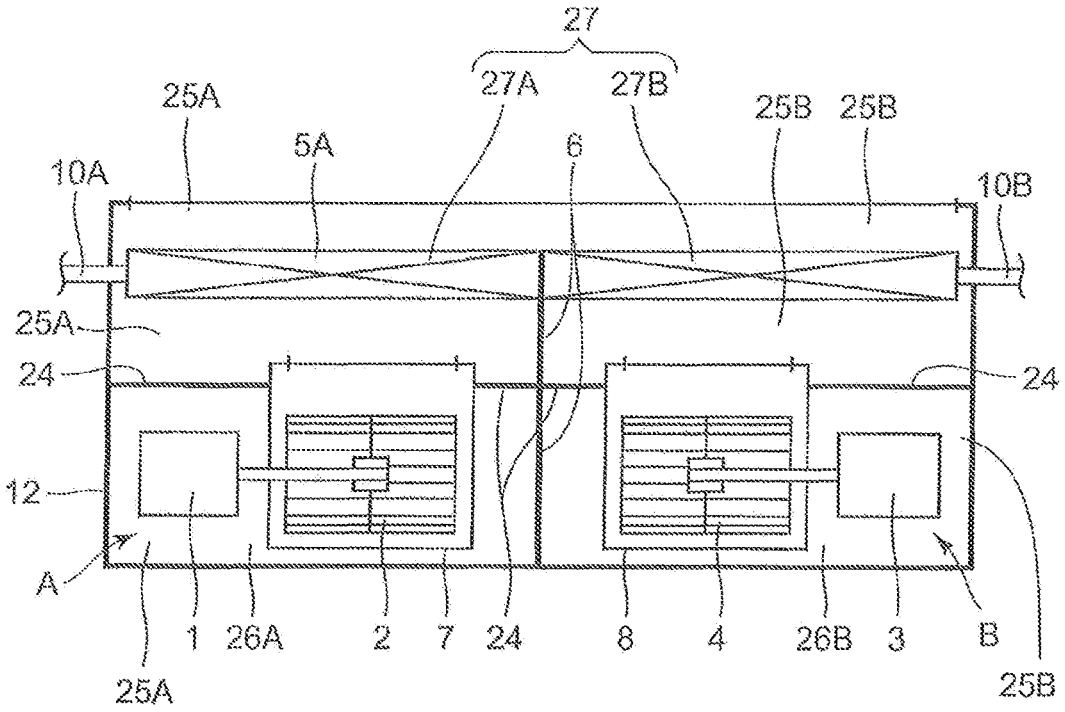
FIG. 2 is a configurational plan view showing the interior of the indoor unit of Embodiment 1.
Figure 3:
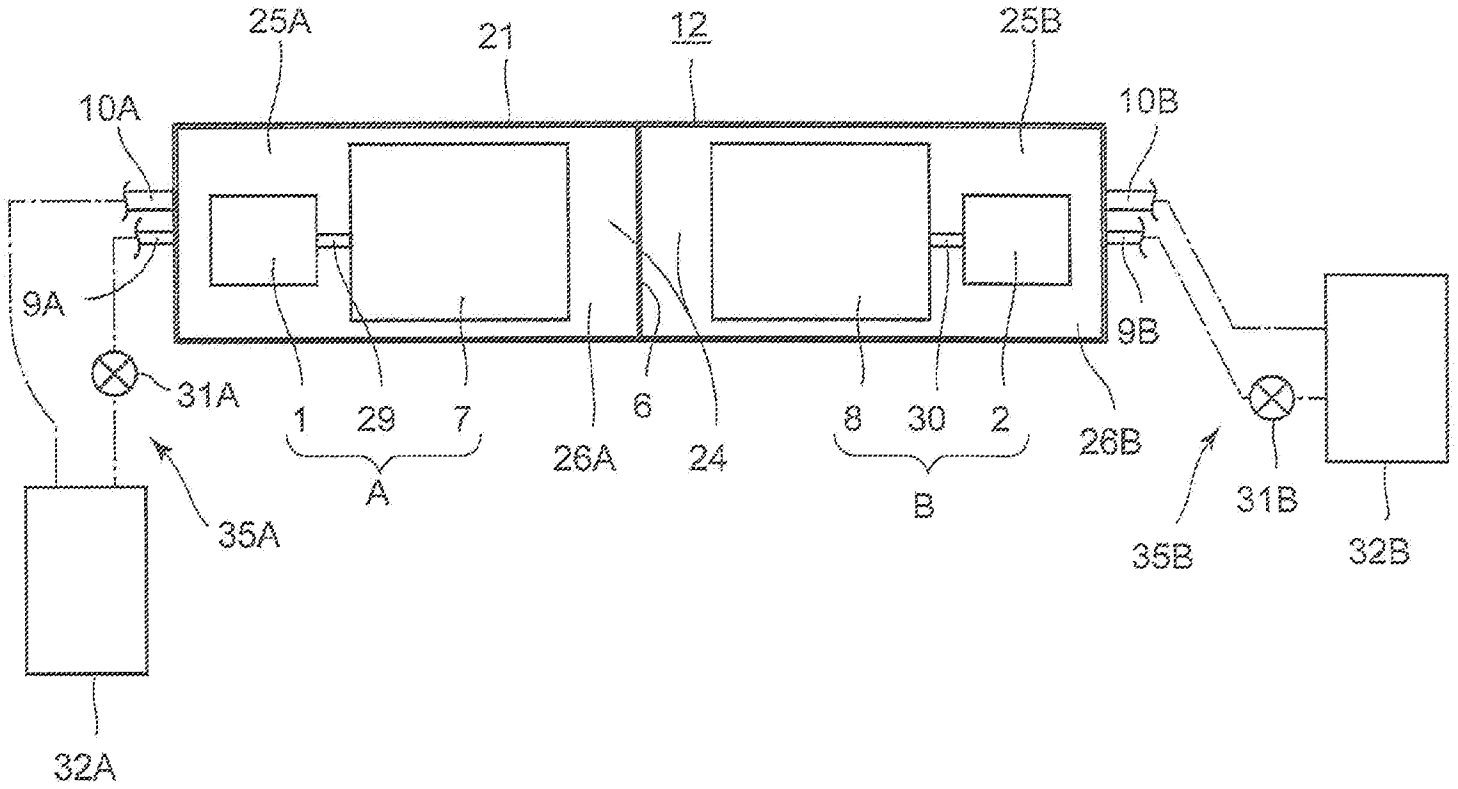
FIG. 3 is a front view showing the indoor unit of Embodiment 1.
Figure 4:
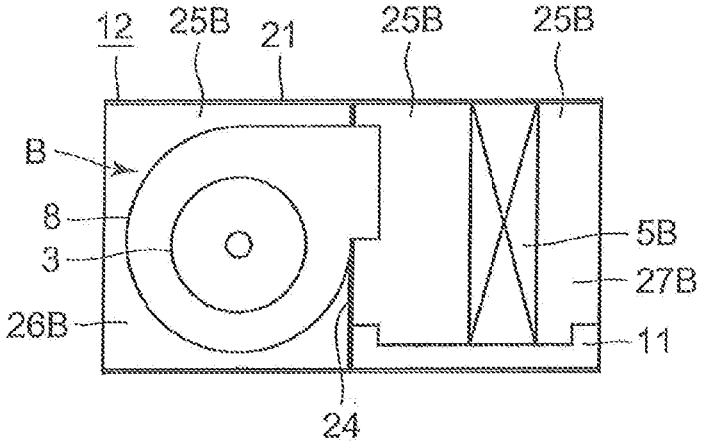
FIG. 4 is a side view showing the indoor unit of Embodiment 1.
Figure 5:
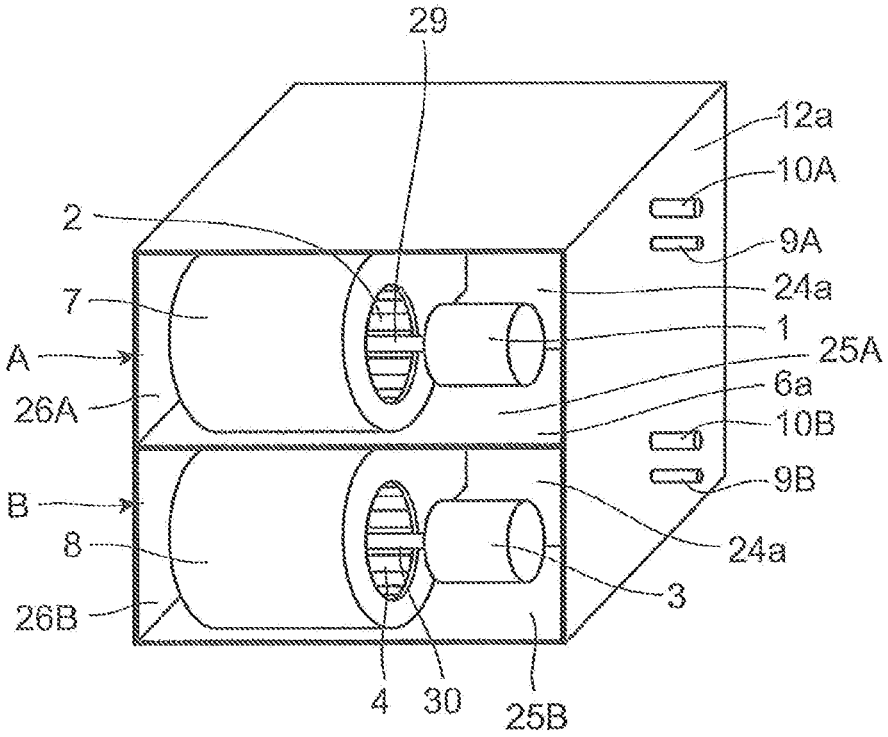
FIG. 5 is a perspective front view in outline of an indoor unit for an air-conditioning apparatus according to Embodiment 2 of the present invention.
Figure 6:
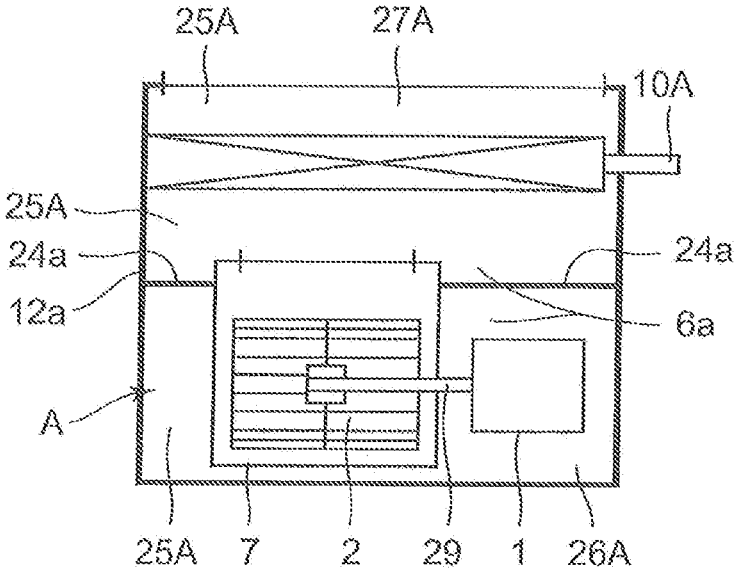
FIG. 6 is a configurational plan view showing the interior of the indoor unit of Embodiment 2.
Figure 7:
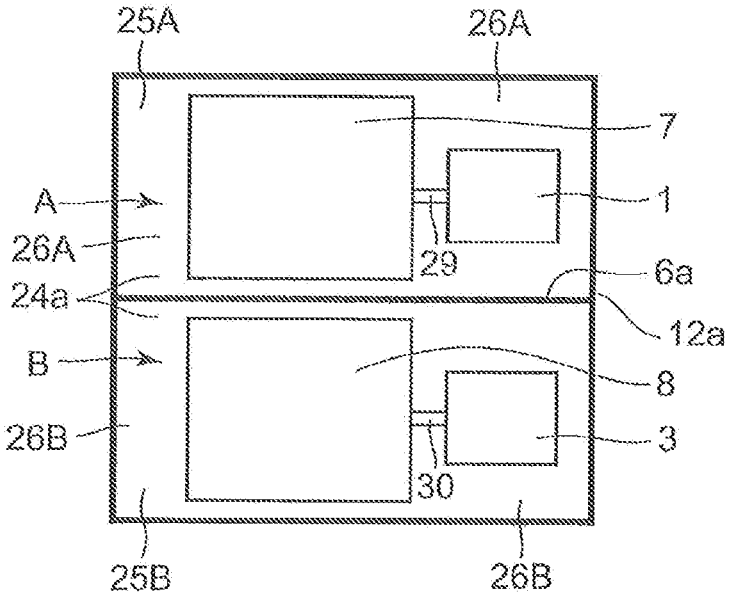
FIG. 7 is a front view showing the indoor unit of Embodiment 2.
Figure 8:
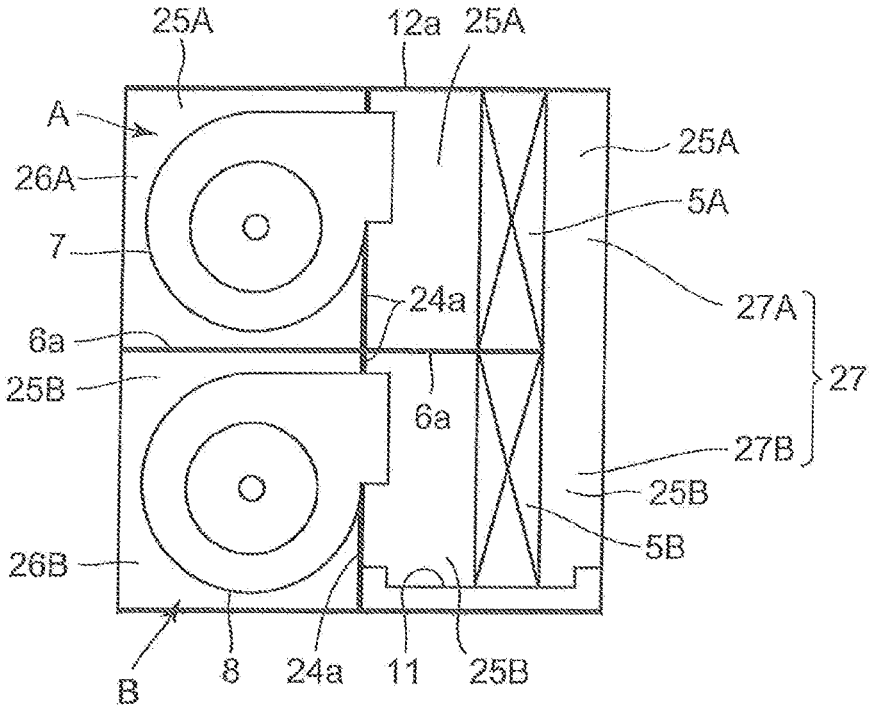
FIG. 8 is a side view showing the indoor unit of Embodiment 2.

FIG. 1 is a perspective front view in outline of an indoor unit for an air-conditioning apparatus according to Embodiment 1; FIG. 2 is a configurational plan view showing the interior of the indoor unit of Embodiment 1; FIG. 3 is a front view showing the indoor unit of Embodiment 1; and FIG. 4 is a side view showing the indoor unit of Embodiment 1.

In FIG. 1 through FIG. 4, the indoor unit for an air-conditioning apparatus according to Embodiment 1 has one box-shaped casing 12 having air inlets 26A, 26B opened in the front surface and an air outlet 27 opened in the back surface. The inside of this box-shaped casing 12 is partitioned into two left and right wind passages 25A, 25B by a partition plate part 6 which is disposed in the front-back direction, roughly at the center of the casing in the left-right direction. Thus, the air outlet 27 is divided into left and right air outlets 27A, 27B, The wind passage 25A communicates the air inlet 26A and the air outlet 27A with each other, while the wind passage 25B communicates the air inlet 26B and the air outlet 27B with each other. The inside of the wind passage 25A and the inside of the wind passage 25B are each partitioned into front and back parts by a partition plate part 24 which is disposed in the left-right direction, roughly at the center of the casing in the front-back direction.

A separate air-sending device A is provided closer to the air inlet 26A in the wind passage 25, and a separate air-sending device B is provided closer to the air inlet 26B in the wind passage 25B. The separate air-sending device A is composed of a fan casing 7 having inlets in the left and right side surfaces and an outlet in the back surface, a fan 2 of a sirocco type, for example, provided inside the fan casing 7, a motor 1 driving the fan 2 to rotate, and a rotary drive shaft 29 of the motor 1 with the shaft leading end fixed on the fan 2. This separate air-sending device A is fixed on the partition plate part 24 so that its outlet is open on the back side of the partition plate part 24. The separate air-sending device A suctions air from a space to be air-conditioned through the air inlet 26A into the wind passage 25A, and blows the air to the outside of the indoor unit through the air outlet 27A. The separate air sending device B is composed of a fan casing 8 having inlets in the left and right side surfaces and an outlet in the back surface, a fan 4 of a sirocco type, for example, provided inside the fan casing 8, a motor 3 driving the fan 4 to rotate, and a rotary drive shaft 30 of the motor 3 with the shaft leading end fixed on the fan 4. This separate air-sending device B is also fixed on the partition plate part 24 so that its outlet is open on the back side of the partition plate part 24. The separate air-sending device B suctions air from a space to be air-conditioned through the air inlet 26B into the wind passage 25B, and blows the air to the outside of the indoor unit through the air outlet 27B.

A separate heat exchanger 5A, which air-conditions the air suctioned through the air inlet 26A, is provided in the wind passage 25A between the separate air-sending device A and the air outlet 27A. A separate heat exchanger 5B, which air-conditions the air suctioned through the air inlet 26B, is provided in the wind passage 25B between the separate air-sending device B and the air outlet 27B. A drain pan 11 which receives dew condensation water from the separate heat exchangers 5A, 5B is disposed under each of these separate heat exchangers 5A, 5B. The separate heat exchanger 5A is connected with an outdoor unit 32A. The separate heat exchanger 5B is connected with an outdoor unit 32B which is separate and independent from the outdoor unit 32A. That is, in this air-conditioning apparatus, the separate heat exchanger 5A of the indoor unit, a refrigerant expansion valve 31A, and the outdoor unit 32A are connected annularly through refrigerant pipes 9A, 10A to configure a refrigerant circuit 35A. On the other hand, the separate heat exchanger 5B of the indoor unit, a refrigerant expansion valve 31B, and the outdoor unit 32B are connected annularly through refrigerant pipes 9B, 10B to configure a refrigerant circuit 35B. The outdoor unit 32A and the outdoor unit 32B each include an accumulator, a refrigerant compressor, a refrigerant flow passage switching valve, an outdoor unit-side heat exchanger, an outdoor unit-side air-sending device, etc. (being all general-purpose components, these are not shown).

Next, the working of this indoor unit will be described. On the side of the wind passage 25A, as the motor 1 of the separate air-sending device A drives the fan 2 to rotate, air is suctioned through the air inlet 26A into the fan casing 7 and a wind is blown out through the outlet. This wind is air-conditioned by being cooled or heated while passing through the separate heat exchanger 5A where a refrigerant is flowing in through the pipes 9A, 10A. Dew condensation water, which is generated on the surface of the separate heat exchanger 5A as the air is cooled, is received by the drain pan 11 and evaporates or is discharged to the outside of the indoor unit. On the wind passage 25B side, as the motor 3 of the separate air-sending device B drives the fan 4 to rotate, air is suctioned through the air inlet 26B into the fan casing 8 and a wind is blown out through the outlet. This wind is air-conditioned by being cooled or heated while passing through the separate heat exchanger 5B where a refrigerant is flowing in through the pipes 9B, 10B.

In general, most motors are designed so as to achieve the highest efficiency when operating at nearly 100% output. The following two cases will be described on the assumption that the two air-sending devices A, B are equal in air-sending capacity.

First example is a case where the indoor unit as a whole is required to have "a capacity equivalent to 50% output operation":

Since the indoor unit of Embodiment 1 uses two separate air-sending devices A, B, a form of operation is possible in which the motor of one of the separate air-sending devices is operated at 100% output while the motor of the other separate air-sending device is stopped (operated at 0% output). Thus, 50% output operation can be performed, and operation at higher-efficiency points can also be performed. By contrast, in a case where an air-sending device having a single motor as in the conventional technology is used, it is necessary to continuously operate the single motor at 50% output.

Next example is a case where the indoor unit as a whole is required to have "a capacity equivalent to 75% output operation":

Since the indoor unit of Embodiment 1 uses the two separate air-sending devices A, B, a form of operation is possible in which the motor of one of the air-sending devices is operated at 75% output while the motor of the other air-sending device is operated at 75% output. Another form of operation is also possible in which one motor is operated at 100% output while the other motor is operated at 50% output. That is, it is possible to perform high-efficiency operation by measuring and acquiring high-efficiency operation points during design and development. By contrast, in a case where an air-sending device having a single motor is used as in the conventional technology, it is necessary to continuously operate the single motor at 75% output.

Regarding the accumulated operating hours, a case where the motors are operated constantly at 50% output for 24 hours will be taken as an example. Specifically, to operate the two motors 1, 3 at the same power, it is conceivable to continuously operate the two motors 1, 3 at 50% output for 24 hours. However, by separately controlling the motors 1, 3, it is possible, for example, to operate the motor 1 at 100% output and the motor 3 at 0% output for the first 12 hours, and to operate the motor 1 at 0% output and the motor 3 at 100% output for the last 12 hours. Thus, the accumulated operating hours of each of the motors 1, 3 can be halved.

As has been described, in Embodiment 1, since the separate air-sending devices A, B are separately controlled according to an operation state of the plurality of outdoor units connected with the indoor unit, it is possible to suppress wasteful energy consumption by stopping the air-sending device on the side of the refrigerant circuit connected with the outdoor unit which has been stopped. Since the partition plate part 6 is provided, it is possible to operate the air-conditioning apparatus with higher efficiency by eliminating a wind bypassing to the separate heat exchanger where no refrigerant is flowing. Moreover, since the heat exchanger of the indoor unit is divided into the left and right parts and the box-shaped casing 12 is formed so that the air-sending device A and the air-sending device B can be disposed next to each other in the horizontal direction, it is possible to realize a low-profile indoor unit by reducing the height dimension of the box-shaped casing 12 of the indoor unit Thus, the indoor unit can be installed even in a case where the installation space inside the ceiling does not have a sufficient height.

Embodiment 2

In Embodiment 1, the plurality of wind passages are disposed side by side. Next, Embodiment 2 will be described in which the plurality of wind passages are disposed on top of each other.

FIG. 5 through FIG. 8 show an indoor unit for an air-conditioning apparatus according to Embodiment 2. As this indoor unit has many configurations in common with Embodiment 1, components that are different from Embodiment 1 will be mainly described in detail. This indoor unit includes one box-shaped casing 12*a* having the air inlets 26A, 26B opened in the front surface and the air outlets 27A, 27B opened in the back surface. The inside of this box-shaped casing 12*a* is partitioned into two upper and lower wind passages 25A, 25B by a horizontal partition plate part 6*a* which is disposed in the front-back direction, roughly at the center of the casing in the upper-lower direction. The inside of the wind passage 25A and the inside of the wind passage 25B are each partitioned into front and back parts by a vertical partition plate part 24*a* which is disposed in the upper-lower direction, roughly at the center of the casing in the front-back direction. The separate air-sending device A is provided closer to the air inlet 26A in the wind passage 25A, and the separate air-sending device B is provided closer to the air inlet 26B in the wind passage 25B. The separate heat exchanger 5A is provided in the wind passage 25A between the separate air-sending device A and the air outlet 27A. The separate heat exchanger 5B is provided in the wind passage 25B between the separate air-sending device B and the air outlet 27B.

As has been described, in Embodiment 2, since the separate air-sending devices are separately controlled according to an operation state of the plurality of outdoor units connected with the indoor unit, it is possible to suppress wasteful energy consumption by controlling so as to stop the air-sending device of the refrigerant circuit connected with the outdoor unit which has been stopped. Since the partition plate part 6*a* is provided, it is possible to operate the air-conditioning apparatus with higher efficiency by eliminating a wind bypassing to the separate heat exchanger where no refrigerant is flowing. Moreover, the width of the box-shaped casing 12*a* of the indoor unit can be reduced, since the heat exchanger of the indoor unit is divided into the separate heat exchangers 5A, 5B and these heat exchangers are disposed on top of each other while the air-sending device A and the air-sending device B are also disposed in the upper and lower wind passages 25A, 25B. Thus, the indoor unit can be suitably installed even in a case where the installation space of the indoor unit inside the ceiling of a room to be air-conditioned has a sufficient height but is limited in width due to the presence of a beam etc.

Embodiment 3

In Embodiments 1 and 2, no mention has been made of ducts which are connected with the air outlets 27A, 27B of the box-shaped casing 12. Embodiment 3 will be described in which ducts having different required static pressures are connected with the air outlets 27A, 27B.

Figure 9:
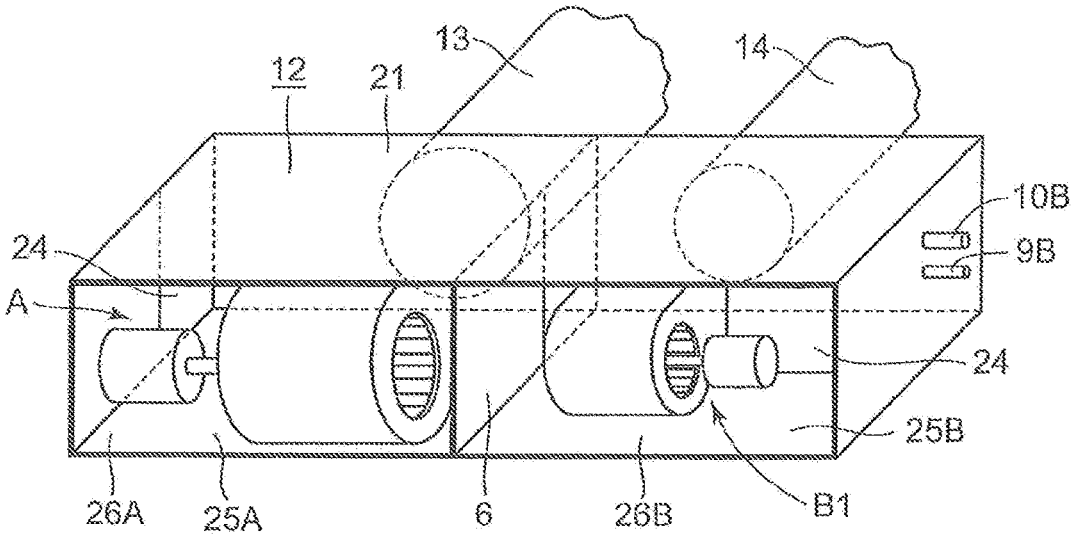
FIG. 9 is a perspective front view in outline of an indoor unit for an air-conditioning apparatus according to Embodiment 3 of the present invention.
Figure 10:
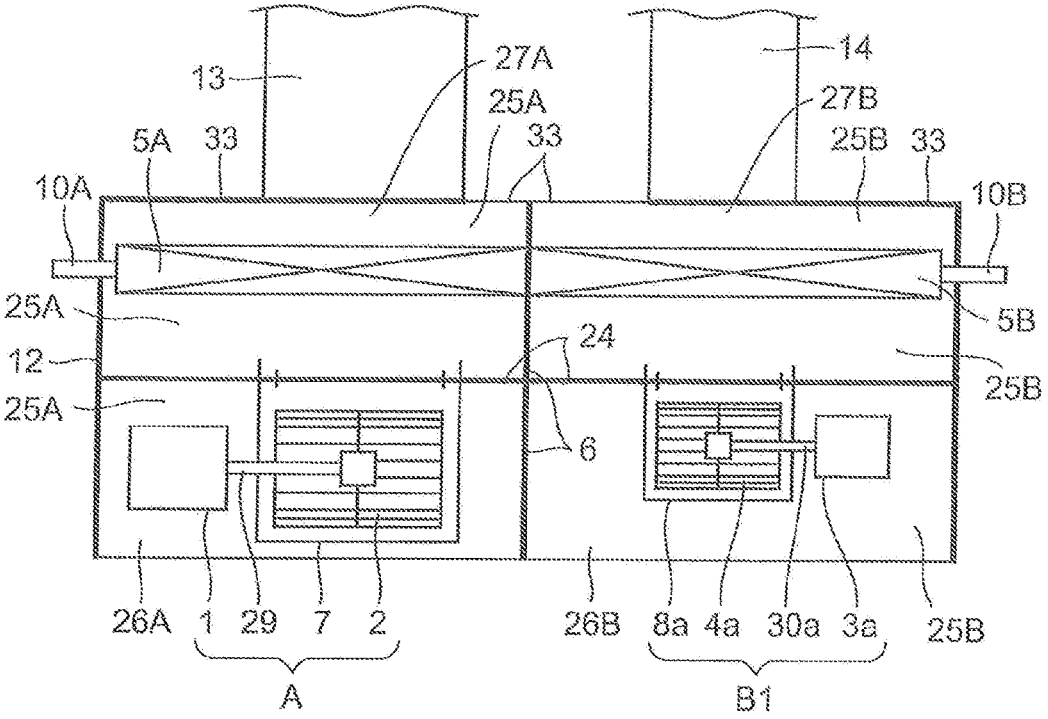
FIG. 10 is a configurational plan view showing the interior of the indoor unit of Embodiment 3.
Figure 11:
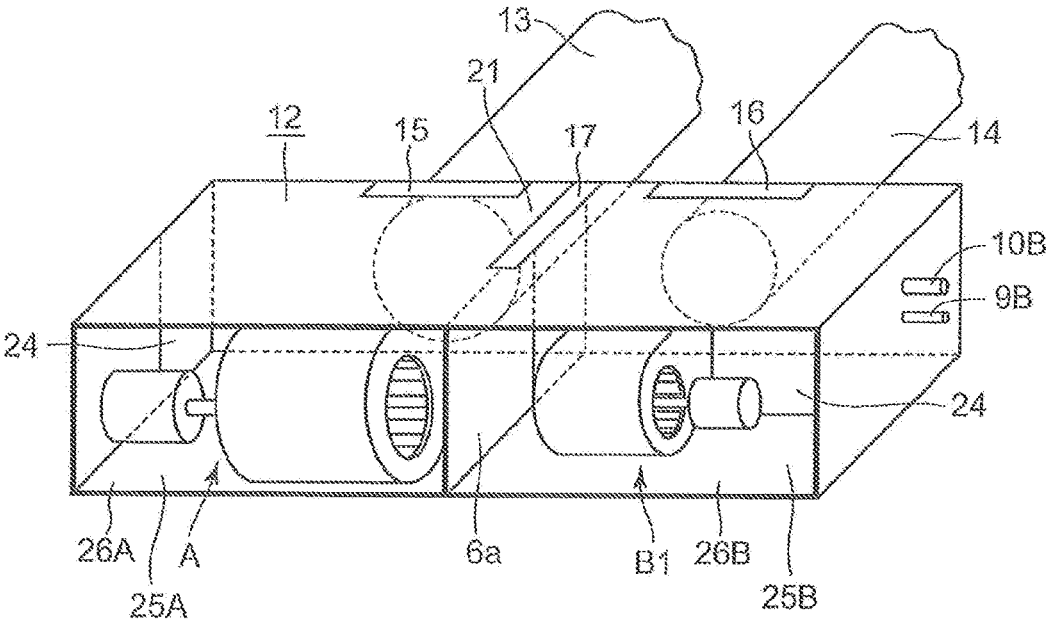
FIG. 11 is a perspective front view in outline of an indoor unit for an air-conditioning apparatus according to Embodiment 4 of the present invention.
Figure 12:
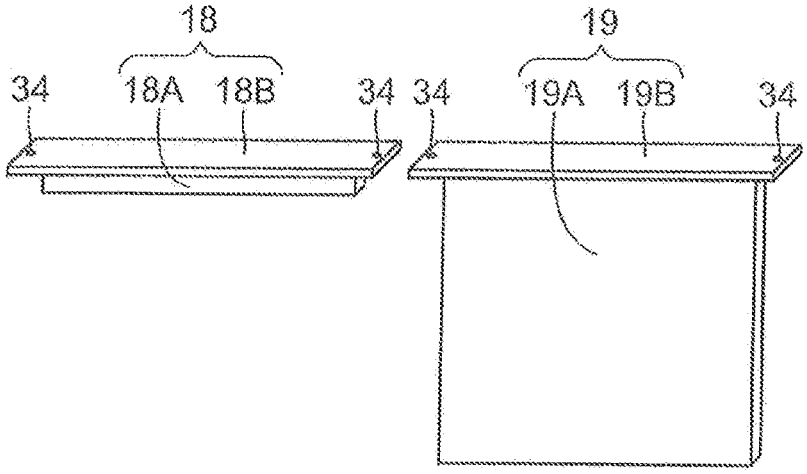
FIG. 12 is an outline view showing a partition plate and a lid plate body used for the indoor unit of Embodiment 4.

FIG. 9 and FIG. 10 show an indoor unit according to Embodiment 3. This indoor unit has the same configuration in many parts as the indoor unit of Embodiment 1 described above. Therefore, configurations that are different from those of the indoor unit of Embodiment 1 will be mainly described in detail. The opening in the back surface of the box-shaped casing 12 is entirely covered with a back plate 33 in which the air outlets 27A, 27B are formed. A duct 13 having a higher required static pressure is connected with the air outlet 27A of the back plate 33, while a duct 14 having a lower required static pressure is connected with the air outlet 27B of the back plate 33. In general, the required static pressure indicates a pressure at which air can be sent by overcoming the flow resistance inside the duct. A separate air-sending device B1, which is composed of a motor 3*a*, a fan 4*a*, a fan casing 8*a*, and a drive shaft 30*a*, is disposed in the wind passage 25B. The air-sending capacity of this separate air-sending device B1 is set to a different air-sending capacity from that of the above-described separate air-sending device A disposed in the wind passage 25A, that is, set to an air-sending capacity smaller than that of the separate air-sending device A.

As has been described, in the indoor unit of Embodiment 3, the separate air-sending devices having air-sending capacities suitable for the required static pressures of the respective ducts are provided in the respective wind passages and controlled. Therefore, even in a case where two rooms to be air-conditioned located close to each other need to be air-conditioned, it is not necessary to install two indoor units but a single indoor unit suffices, so that the burden of carrying in the indoor unit as well as the installation space of the indoor unit can be reduced. The same effect can also be obtained in a case where this Embodiment 3 is applied to an indoor unit in which the separate heat exchangers 5A, 5B are disposed on top of each other as shown in FIG. 5 through FIG. 8. Moreover, the operation efficiency can be enhanced since an air-sending device having an air-sending capacity according to the required static pressure can be used.

Embodiment 4

In Embodiment 3, the case has been described where the ducts 13, 14 having different required static pressures are connected with the air outlets 27A, 27B, and the air-sending devices A, B having different air-sending capacities are provided in the corresponding wind passages 25A, 25B. Next, Embodiment 4 will be described in which an air transfer wind passage formed at the air outlets 27A, 27B or the back end of the partition plate part is covered in an openable/closable manner.

FIG. 11 through FIG. 18 show an indoor unit according to Embodiment 4. This indoor unit has the same configuration in many parts as the indoor unit of Embodiment 3 described above. Therefore, configurations that are different from those of the indoor unit of Embodiment 3 will be mainly described. Specifically, a partition plate part 6*b* has a cutout at a position between the separate heat exchangers 5A, 5B and the air outlets 27A, 27B. Thus, an air transfer wind passage 28, which communicates between the two wind passages 25A, 25B, is formed between the back end of the partition plate part 6*b* and the back plate 33. This indoor unit includes a partition plate 19 which blocks either the air transfer wind passage 28 or the air outlets 27A, 27B in an openable/closable manner. The partition plate 19 is composed of an insert portion 19A having a vertically-long plate shape and a lid portion 19B provided on the upper surface of the insert portion 19A and having a horizontal plate shape. A first insert opening 17 is formed in an upper metal plate 21 of the box-shaped casing 12, at a position facing the air transfer wind passage 28. The insert portion 19A of the partition plate 19 is accommodated in this first insert opening 17 in an insertable/removable manner. Second insert openings 15, 16 are formed in the upper metal plate 21 of the box-shaped casing 12, at positions facing the air outlets 27A, 27B. The insert portion 19A of the partition plate 19 is also accommodated in these second insert openings 15, 16 in an insertable/removable manner.

A lid plate body 18 is composed of an insert portion 18A having a vertically-short plate shape and a lid portion 18B provided on the upper surface of the insert portion 18A and having a horizontal plate shape. The insert portion 18A of this lid plate body 18 is accommodated in any of the first insert opening 17 and the second insert openings 15, 16 in an insertable/removable manner, and is fitted into the first insert opening 17 or the second insert openings 15, 16, in which the partition plate 19 is not used, to seal the insert opening.

Figure 13:
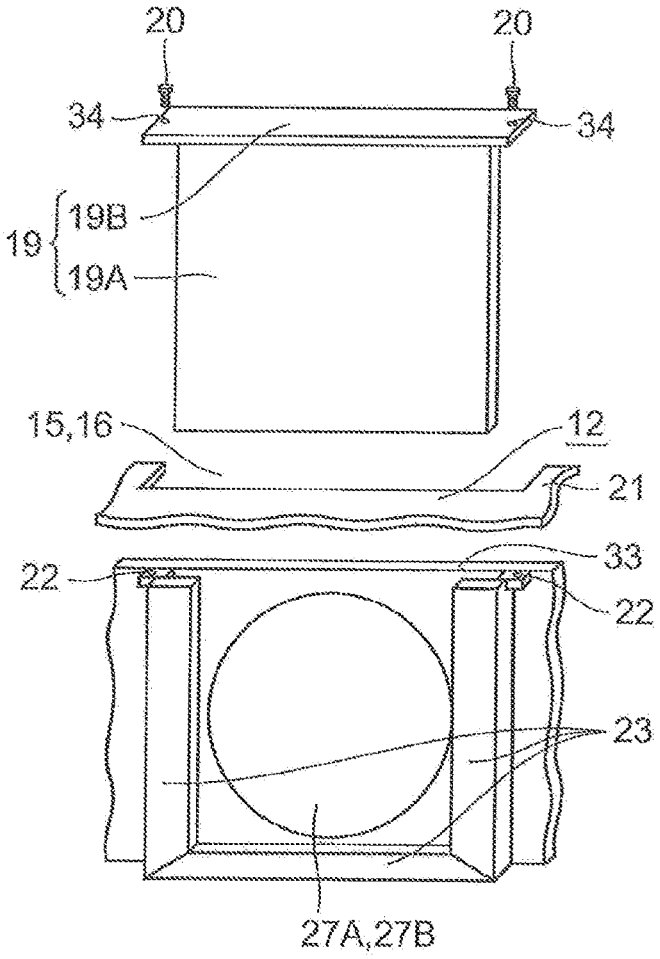
FIG. 13 is a partially exploded perspective view showing an aspect where the partition plate is fitted into a second insert opening of the indoor unit of Embodiment 4.

In FIG. 13, fixing groove parts 23, 23, 23 having an L-shaped cross-section are provided on the left and right sides and at a lower part in the vicinity of the air outlet 27A (or the air outlet 27B) in the inner wall of the back plate 33. Of these groove parts, the left and right fixing groove parts 23, 23 have internal thread portions 22, 22, on which fixing screws 20, 20 are screwed, provided at the upper end. The upper opening surrounded by the left and right fixing groove parts 23, 23 is located under the second insert opening 15 (or the second insert opening 16).

Figure 14:
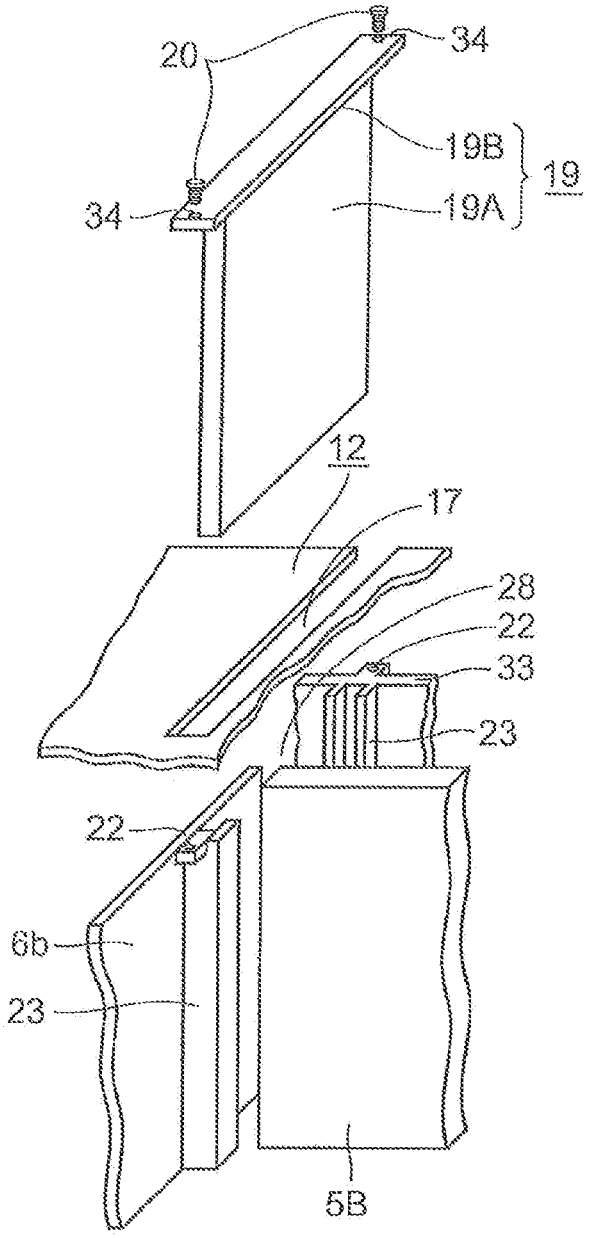
FIG. 14 is a partially exploded perspective view showing an aspect where the partition plate is fitted into a first insert opening of the indoor unit of Embodiment 4.

Here, FIG. 13 and FIG. 14 show a method for fixing the partition plate 19.

FIG. 13 shows a case where the partition plate 19 is inserted into the second insert openings 15, 16 of the upper metal plate 21 of the box-shaped casing 12, and FIG. 14 shows a case where the partition plate 19 is inserted into the first insert opening 17 of the upper metal plate 21 of the box-shaped casing 12.

In FIG. 14, the fixing groove parts 23, 23 are provided at positions on both sides of the air transfer wind passage 28 between the side wall of the partition plate part 6*b* and the inner wall of the back plate 33. The internal thread portions 22, 22 are provided at the upper ends of these fixing groove parts 23, 23. The upper opening between the two fixing groove parts 23, 23 is located under the first insert opening 17. The insert portion 19A of the partition plate 19 is inserted along the fixing groove parts 23, 23 on both sides, and the fixing screw 20 passed through a hole 34 of the lid portion 19A is screwed on the internal thread portion 22. Thus, the partition plate 19 is fixed so as to block the second insert openings 15, 16 or the first insert opening 17. The same method as has been described for the partition plate 19 applies to a case where the lid plate body 18 is fixed so as to cover the second insert openings 15, 16 or the first insert opening 17.

FIG. 15 through FIG. 18 show insert patterns for the use of the lid plate body 18 and the partition plate 19.

"Insert Pattern A"

Figure 15:
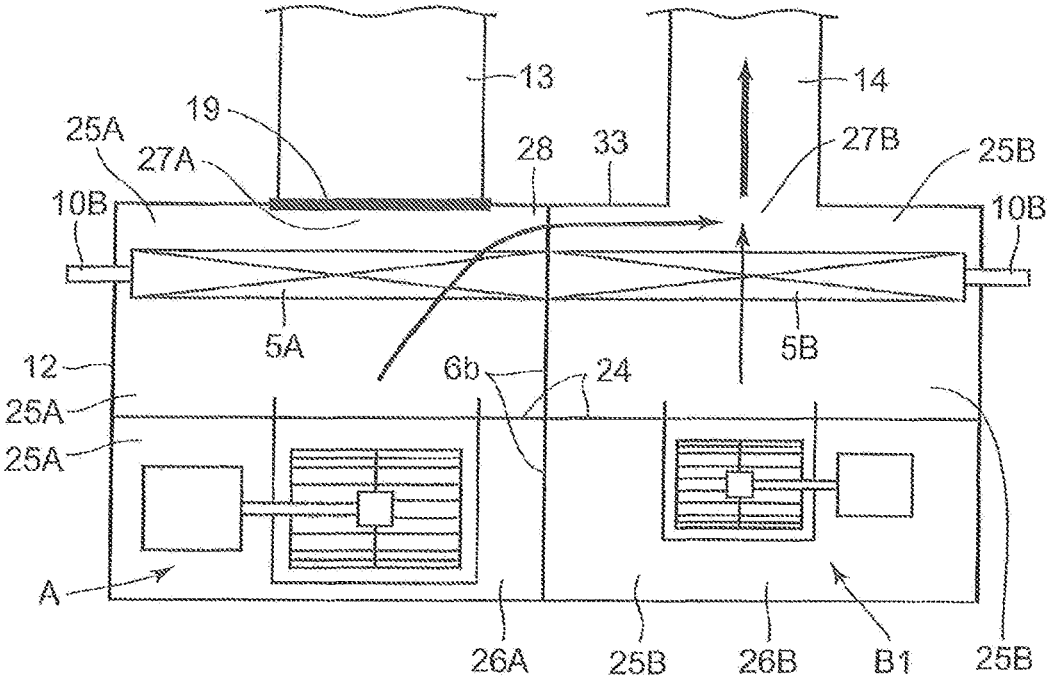
FIG. 15 is a configurational plan view showing an aspect where an air outlet to a duct having a higher required static pressure of the indoor unit of Embodiment 4 is blocked with the partition plate.
Figure 16:
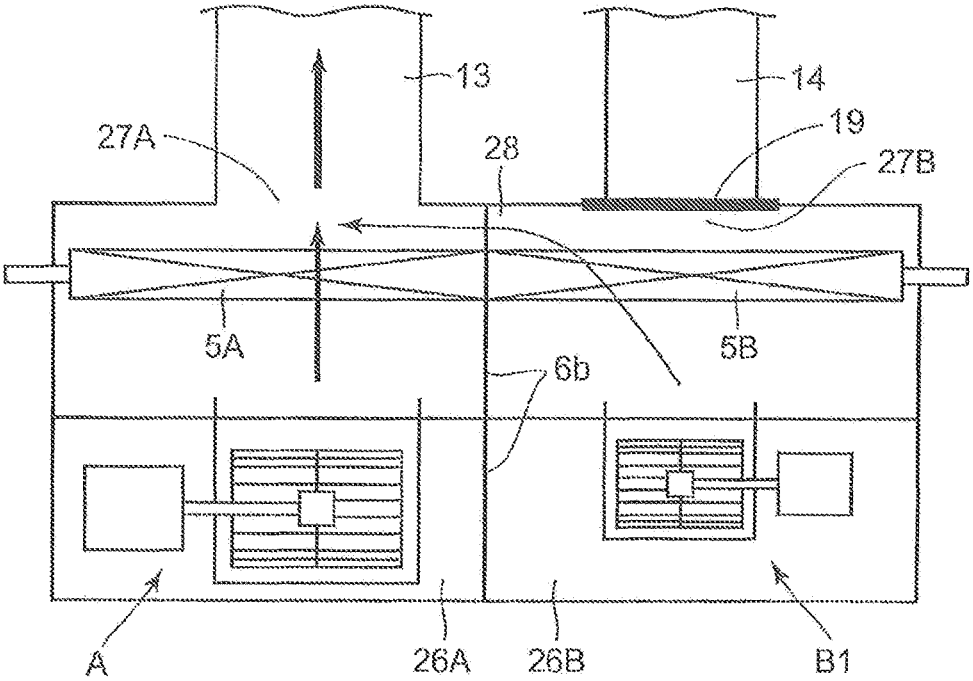
FIG. 16 is a configurational plan view showing an aspect where an air outlet to a duct having a lower required static pressure of the indoor unit of Embodiment 4 is blocked with the partition plate.

FIG. 15 shows a pattern in which the partition plate 19 is inserted into the second insert opening 15 while the lid plate bodies 18 are fitted into and cover the second insert opening 16 and the first insert opening 17. FIG. 16 shows a pattern in which the partition plate 19 is inserted into the second insert opening 16 while the lid plate bodies 18 are fitted into and cover the second insert opening 15 and the first insert opening 17. Thus, it is possible to block the opening of one of the ducts and to perform air conditioning using only the other duct, by changing the type to be used and the position of use of the partition plate 19 and the lid plate body 18. For example, in a case where two rooms are air-conditioned using this indoor unit, and one of the rooms does not need to be air-conditioned in a certain season, it is possible to operate the air-conditioning apparatus with high efficiency by sending winds from the two air-sending devices A, B preferentially to one of the duct 13 and the duct 14 which is connected with the room which needs to be air-conditioned.

"Insert Pattern B"

Figure 17:
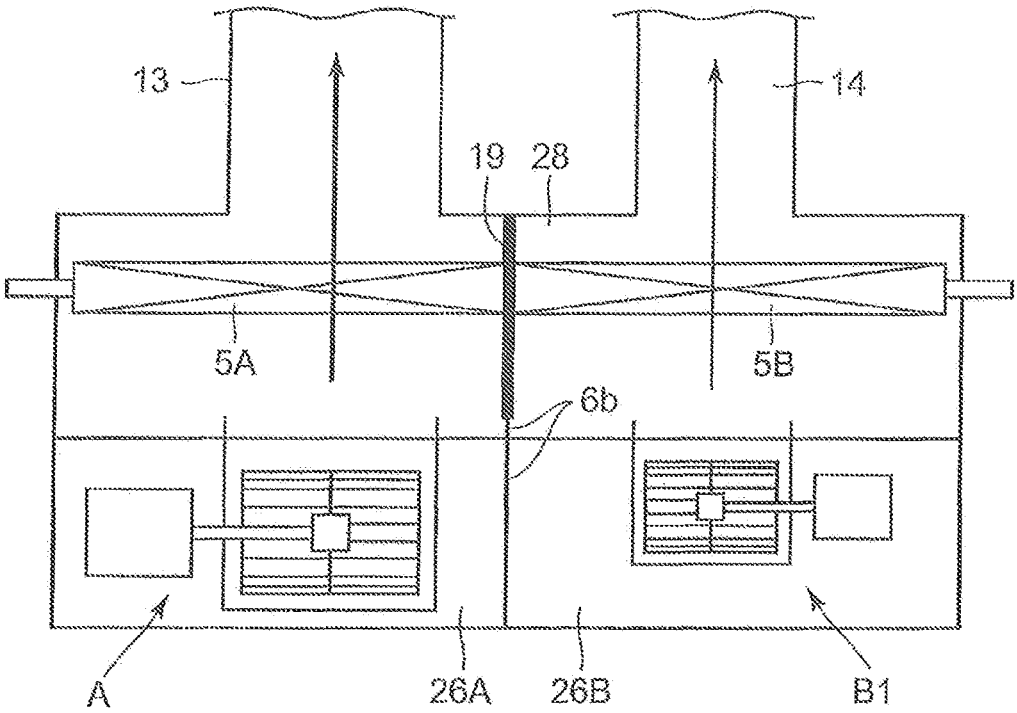
FIG. 17 is a configurational plan view showing an aspect where an air transfer wind passage of the indoor unit of Embodiment 4 is blocked with the partition plate.

FIG. 17 shows a pattern in which the partition plate 19 is inserted into the first insert opening 17 while the lid plate bodies 18 are fitted into and cover the second insert openings 15, 16. Thus, as with the state shown in FIG. 9 and FIG. 10, the wind passage 25A and the wind passage 25B are completely separated from each other, so that separate operation can be performed according to the requirement for air conditioning of the rooms connected with the ducts 13, 14.

"Insert Pattern C"

Figure 18:
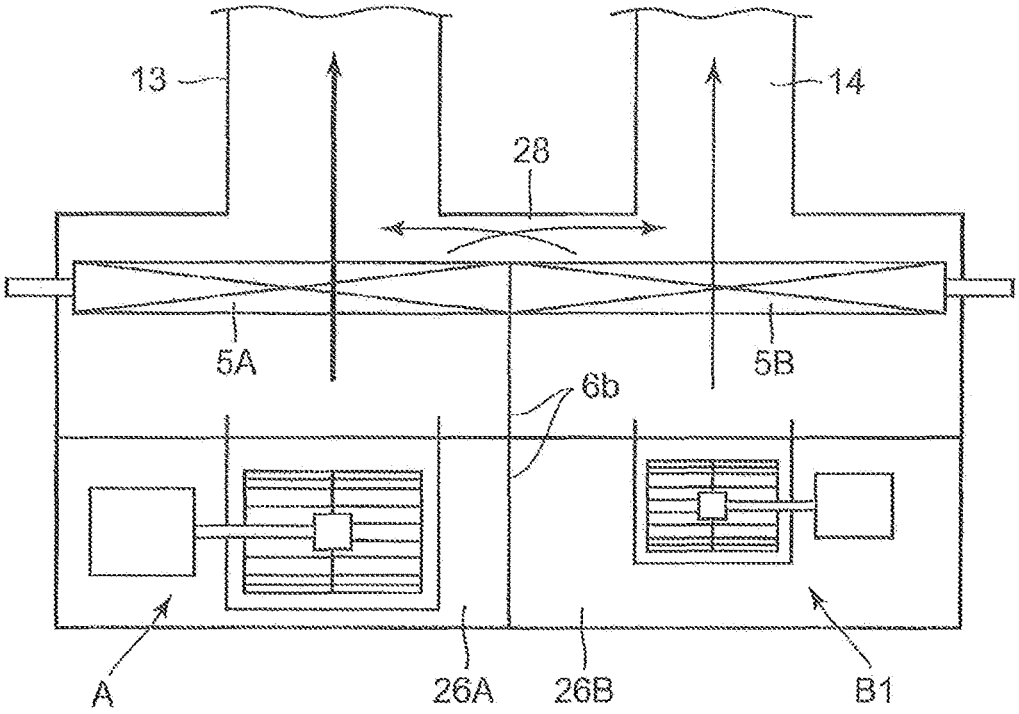
FIG. 18 is a view showing an aspect where the partition plate is fitted into none of the first insert opening and the second insert openings of the indoor unit of Embodiment 4.

FIG. 18 shows a pattern in which the three lid plate bodies 18, 18, 18 are fitted into and cover all of the second insert openings 15, 16 and the first insert opening 17. Thus, it is possible to supply winds from both of the air-sending devices A, B to both of the duct 13 having a higher required static pressure and the duct 14 having a lower required static pressure according to the wind passage resistance of each duct.

As has been described, the partition plate 19 and the lid plate body 18 are appropriately and selectively fitted into the first insert opening 17 and the second insert openings 15, 16. Therefore, even in a case where a change occurs in the state of use of rooms to be air-conditioned which are connected with the outlet-side ends of the ducts 13, 14, it is possible to secure a proper amount of wind to be blown out to the rooms to be air-conditioned according to the change in state of use and to thereby operate the air-conditioning apparatus with high efficiency, by using the appropriate number of partition plates 19 and lid plate bodies 18 at appropriate positions.

While the example where two wind passages are formed inside the box-shaped casing has been described in Embodiments 1 to 4, the present invention is not limited to this example. For example, the present invention is also applicable to an indoor unit in which three wind passages are formed by two partition plate parts. Alternatively, four or more wind passages may be formed by using three or more partition plate parts.

REFERENCE SIGNS LIST

A separate air-sending device B, B1 separate air-sending device 1, 3, 3*a* motor 2, 4, 4*a* fan 5A, 5B separate heat exchanger 6, 6*a*, 6*b* partition plate part 9A, 9B, 10A, 10B refrigerant pipe 12 box-shaped casing 13, 14 duct 15, 16 second insert opening 17 first insert opening 18 lid plate body 19 partition plate 25A, 25B wind passage 26A, 26B air inlet 27A, 27B air outlet 28 air transfer wind passage 32A, 32B outdoor unit 35A, 35B refrigerant circuit

The invention claimed is:

1. An indoor unit for an air-conditioning apparatus, comprising:

one box-shaped casing having an air inlet and an air outlet;

a partition plate part partitioning an inside of the box-shaped casing to form at least two wind passages communicating the air inlet and the air outlet with each other;

a plurality of separate air-sending devices respectively provided in the wind passages to suction air through the air inlet into the wind passage and blow out the air through the air outlet;

separate heat exchangers respectively provided between the separate air-sending device and the air outlet in each of the wind passages, connected with a corresponding independent outdoor unit to configure a separate refrigerant circuit, and air-conditioning the air suctioned through the air inlet;

a controller programmed to, in accordance with an accumulated operating time period of each of the separate air-sending devices, determine a separate air-sending device, of the separate air-sending devices, to be operated;

an air transfer wind passage for communicating between the wind passages through a cutout of the partition plate part located between the separate heat exchangers and the air outlets; and a partition plate, different from the partition plate part, for blocking the air transfer wind passage or the air outlets in an openable/closable manner, wherein a first insert opening in the box-shaped casing for accommodating the partition plate in an insertable/removable manner is formed at a position of the box-shaped casing and facing the air transfer wind passage, and second insert openings in the box-shaped casing for accommodating the partition plate in an insertable/removable manner are formed at positions of the box-shaped casing and facing the air outlets.

2. The indoor unit for an air-conditioning apparatus of claim 1, further comprising ducts each connected with the air outlet of the box-shaped casing, wherein air-sending capacities of the separate air-sending devices are set in accordance with required static pressures of the each of the ducts.

3. The indoor unit for an air-conditioning apparatus of claim 1, wherein the controller controls the determined separate air-sending device of the separate air-sending devices to operate.

4. The indoor unit for an air-conditioning apparatus of claim 3, wherein the controller controls another separate air-sending device, other than the determined separate air-sending device, to not operate.

5. The indoor unit for an air-conditioning apparatus of claim 1, wherein the controller controls a motor of the determined separate air-sending device of the separate air-sending devices to operate.

6. The indoor unit for an air-conditioning apparatus of claim 5, wherein the controller controls the motor of the determined separate air-sending device to operate at 50% output, and the controller controls a motor of another separate air-sending device, other than the determined separate air-sending device, to operate at 50% output.

7. The indoor unit for an air-conditioning apparatus of claim 5, wherein the controller controls the motor of the determined separate air-sending device to operate at 75% output, and the controller controls a motor of another separate air-sending device, other than the determined separate air-sending device, to operate at 25% output.

8. The indoor unit for an air-conditioning apparatus of claim 5, wherein the controller controls a motor of another separate air-sending device, other than the determined separate air-sending device, to not operate.

9. The indoor unit for an air-conditioning apparatus of claim 8, wherein the controller controls the motor of the determined separate air-sending device to operate at 100% output.

10. An indoor unit for an air-conditioning apparatus, comprising:

one box-shaped casing having an air inlet and an air outlet;

a partition plate part partitioning an inside of the box-shaped casing to form at least two wind passages communicating the air inlet and the air outlet with each other;

a plurality of separate air-sending devices respectively provided in the wind passages to suction air through the air inlet into the wind passage and blow out the air through the air outlet;

separate heat exchangers respectively provided between the separate air-sending device and the air outlet in each of the wind passages, connected with a corresponding independent outdoor unit to configure a separate refrigerant circuit, and air-conditioning the air suctioned through the air inlet;

an air transfer wind passage for communicating between the wind passages through a cutout of the partition plate part located between the separate heat exchangers and the air outlets; and a partition plate, different from the partition plate part, for blocking the air transfer wind passage or the air outlets in an openable/closable manner, wherein a first insert opening in the box-shaped casing for accommodating the partition plate in an insertable/removable manner is formed at a position of the box-shaped casing and facing the air transfer wind passage, and second insert openings in the box-shaped casing for accommodating the partition plate in an insertable/removable manner are formed at positions of the box-shaped casing and facing the air outlets.

* * * * *